US005120258A

United States Patent [19]

Carlton

[11] Patent Number: 5,120,258

[45] Date of Patent: Jun. 9, 1992

[54] LOW INDUCTANCE SHIELDED CABLE TO PRINTED CIRCUIT BOARD CONNECTION APPARATUS

[75] Inventor: Stephen C. Carlton, Plano, Tex.

[73] Assignee: Alcatel Network Systems, Inc., Richardson, Tex.

[21] Appl. No.: 783,442

[22] Filed: Oct. 28, 1991

[51] Int. Cl.[5] ..... H01R 13/00

[52] U.S. Cl. ..... 439/581; 439/63

[58] Field of Search ..... 439/63, 92, 578–585

[56] References Cited

U.S. PATENT DOCUMENTS 3,879,103 4/1975 Peltola et al. ..... 439/581
4,012,099 3/1977 Worcester ..... 439/581
4,645,288 2/1987 Stur-A ..... 439/581

*Primary Examiner*—Joseph H. McGlynn
*Attorney, Agent, or Firm*—Bruce C. Lutz; Dennis O. Kraft

[57] ABSTRACT

A low inductance shielded cable connector to printed circuit interface with an isolated chassis ground can be obtained by a multilayer printed circuit board and plated-through holes. Two or more layers of the printed circuit board are used to provide a capacitive connection to chassis ground and other layers are used to provide connections for signal ground (cable ground) and signal connector leads. The direct contact of the shielded cable connector to a multiplicity of points on the exterior layer of the printed circuit board, wherein the contact points completely encircle the signal conductor, substantially eliminates both radiation of signal and pickup of signals by the signal conductor.

8 Claims, 1 Drawing Sheet

LOW INDUCTANCE SHIELDED CABLE TO PRINTED CIRCUIT BOARD CONNECTION APPARATUS

THE INVENTION

The present invention pertains generally to electronics and more specifically to shielded cables. Even more specifically, it pertains to an approach to connecting a shielded cable to a printed circuit board to provide low inductance, isolation of signal and chassis grounds while preventing electromagnetic radiation and simultaneously minimizing pickup of electromagnetic signals by the shielded conductor.

BACKGROUND

The problem of providing a low inductance connection between a shielded cable and circuitry on a printed circuit board has been in existence for a long time. It is complicated when there is also a requirement that a chassis ground be isolated, from a DC standpoint, from the signal ground. This is accomplished in some prior art approaches by capacitively coupling the signal ground to chassis ground. One such example is found in a U.S. Pat. No. 4,827,378, issued May 1, 1989, to Rockwell International Corporation, and since assigned to the assignee of the present invention. The referenced patent, however, uses a spring to provide the contact between the shielded cable connector and the capacitor providing the connection to chassis ground. This point contact acts like a pigtail connection and introduces inductance into the circuit which raises the impedance and thus, reduces the ground shield effectiveness. The ground contact at only one or a few points surrounding the signal conductor allows the radiation of electromagnetic signals as well as the pickup of electromagnetic signals from nearby high frequency sources.

Another approach to solving the present problem utilizes an expensive coaxial connector where a high cost dielectric such as ceramic is used. While the connector performed reasonably well for the purposes for which it was designed, the connector was not designed to utilize compliant pin technology and the cost was prohibitive in most commercial applications.

The present invention utilizes printed circuit board material as dielectric and high capacitance can be obtained by using multilayers. Substantially continous circumferential contact between the connector and the capacitor can be obtained by proper methods of attaching the connector to the printed circuit board wherein there is substantially 360 degree contact between the connector and one layer of capacitive material. With proper design of plated-through holes and intermediate layers of conductive material in a multilayer printed circuit card, a cable connector may be produced which has the desired low inductance along with a relatively low cost and which still maintains EMC (electromagnetic compliance) standards.

It is therefore an object of the present invention to provide an improved shielded cable connector to printed circuit interface where it is desirable to have an isolated chassis ground and/or high standards of electromagnetic signal shielding.

Other objects and advantages will be apparent from a reading of the specification and appended claims in conjunction with the drawings wherein:

FIG. 1 is an exploded view of a printed circuit board, a capacitive chassis ground connection and a single shielded cable connector; and FIG. 2 is a side view of a form of the inventive concept for illustrating from a different prospective the signal paths between a shielded cable connector and layers of conductive material in a multilayer printed circuit board.

DETAILED DESCRIPTION

Figure 1:
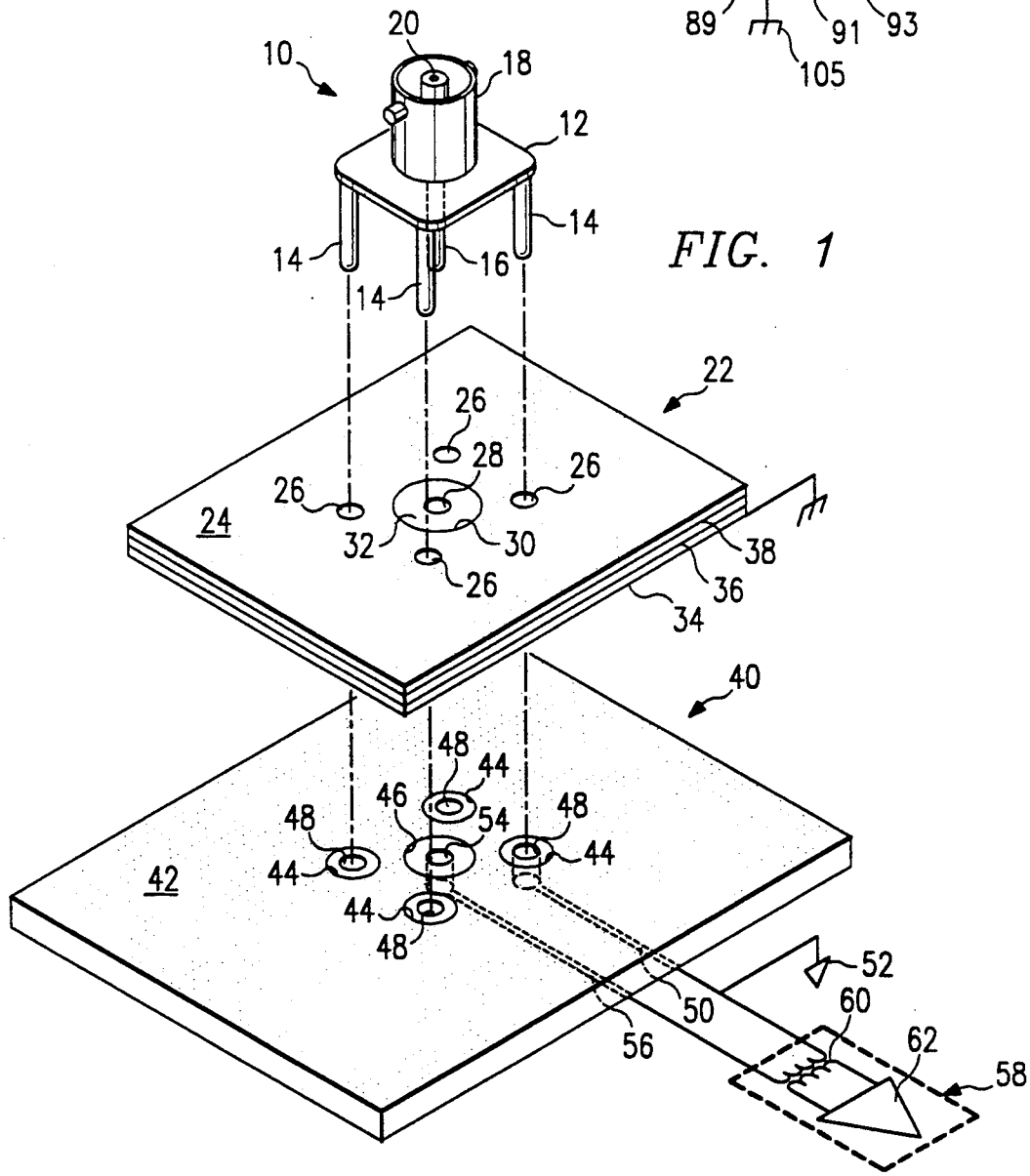

In FIG. 1 a cable connector is generally illustrated as 10 having a base 12 and associated grounding pins 14 which in one embodiment were of the type designated as compliant and thus additionally served as attachment means. Also shown is a signal conductor as a dash line and designated as 16. A barrel 18 surrounds a central female contact for the signal and designated as 20. A multilayer capacitor is designated generally as 22 and includes an exterior or upper conductive layer designated as 24. Four plated-through openings are designated as 26. In a central position between openings 26 is an opening 28 that passes all the way through capacitor 22. The material 24 does not reach all the way to opening 28 and instead produces a larger opening surrounding opening 28 and this larger opening in the conductive material is designated as 30. Between opening 28 and the edges of opening 30, there exists insulative dielectric material of the printed circuit board and this dielectric is designated as 32. The capacitor 24 is shown as having four layers of conductive material with conductor 24 being the first layer. Another exterior layer would be designated as 34 and two interior layers are designated as 36 and 38. Plated-through hole technology would allow the connection of layers 34 and 38 together for chassis ground while layers 24 and 36 are connected together for shield ground. The insertion of the connector 10 into capacitor 22 via the pressures exerted by pins 14 on the sides of plated-through holes 26 provides an electrical and mechanical connection to conductive layers 24 and 36. With proper insertion techniques, the entire base 12 provides contact with layer 24 completely circumscribing the opening 28. The pin 16 passes through opening 28 (not a plated-through hole) and is not electrically connected to any of the layers in capacitor 22. A further printed circuit board portion 40 is illustrated with a conductive pattern 42. There are a plurality of openings illustrated as 44 in the conductive pattern 42 surrounding a further opening 46. Within each of the openings 44, there are additional plated-through holes designated as 48 to receive the pins 14 and to provide a signal ground path. One of these plated-through holes 48 is shown connected to a dash line circuit path designated as 50 and connected to ground 52. Within opening 46 a plated-through hole is shown and designated as 54. Plated-through hole 54 is electrically connected to a dash line signal path designated as 56 which when connector 10 is firmly attached to both printed circuit portions 22 and 40 provides a completion of electrical connection from the female connector portion 20, to the pin 16, the plated-through hole 54 to the signal path 56. A dash line block 58 is shown containing a transformer 60 and an amplifier 62. The components of block 58 may be on one surface of the printed circuit board or may be connected via a connector to these components placed elsewhere. The dash line box 58 is merely illustrated to indicate that there is further circuitry of some type connected to signal paths 50 and 56.

Figure 2:
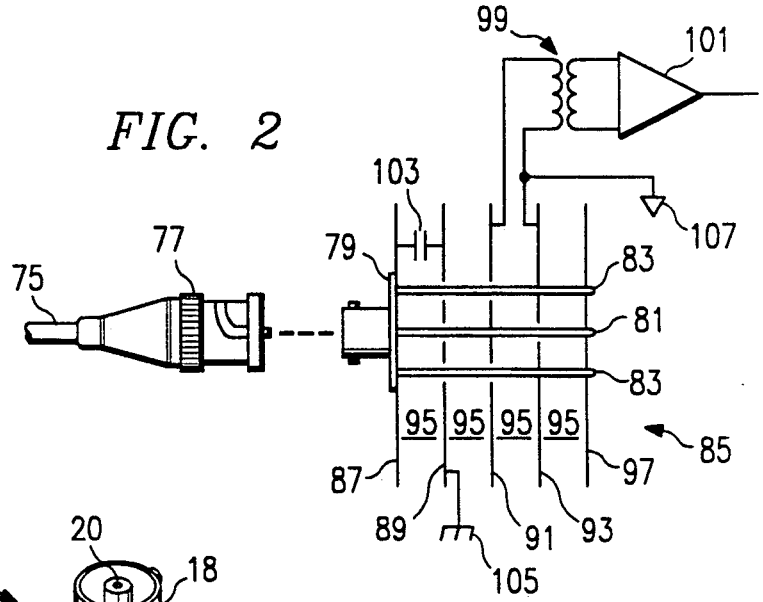

In FIG. 2 a shielded cable 75 is shown along with a male cable connector 77. A printed circuit board female connector 79 is shown with signal conductor 81 and signal ground pins or conductors 83. A multilayer printed circuit board is shown generally as 85 having an exterior surface conductive pattern 87, a chassis ground conductor 89, a signal conductor layer 91, a circuit or shielded ground layer 93, and insulative dielectric 95 between each of the designated layers. A further conductor is designated as 97. The layers 91 and 93 are shown connected to a transformer designated as 99 which is then electrically connected to an amplifier designated as 101. A symbolism of the capacitive connection between conductive layers 87 and 89 is represented by a capacitor designated as 103. It may be observed that the layer 89 does not contact any of the terminals 83 or 81. The signal layer, however, contacts terminal 81 while the cable ground is connected to layer 93. Chassis ground is designated as 105 and is connected to layer 89. Signal ground is designated as 107.

OPERATION

The operation of the invention is reasonably straightforward in view of the above comments. The signal conductor pin 20 and its associated pin 16 needs to be surrounded by shielding material at all times to prevent the reception or transmission of electromagnetic interference signals. Further, the shield needs to be connected at least at signal frequencies to chassis ground. To prevent ground current problems, this needs to be a capacitive connection not a direct voltage connection. This is accomplished by using the capacitive interaction of layers of metal insulated from each other by dielectric such as can be obtained in a multilayer printed circuit board. A capacitor is formed in such a printed circuit board by connecting alternate layers together via plated-through holes to form one terminal of a capacitor and the remaining layers are connected together using further plated-through holes. Printed circuit board 22 achieves this result with the pins 14 of connector 10 being connected to layer 24 and layer 36. Chassis ground is connected to the intermediate layers 34 and 38 to form the other plate of the capacitor represented by 103 in FIG. 2. The pin 16 does not connect to any of the layers in portion 22 of the total product. Pin 16, however, does connect to plated-through hole 54 and thus, to lead 56 which goes to the circuit within dash line block 58. At least one of the pins 14 is also directly connected to the plated-through hole 48 and thus, to lead 50 and from there to signal ground 52 as well as to a lead of transformer 60 thereby completing the circuit to dash line block 58. The contact formed between base 12 and the conductive plate 24 in the area completely surrounding opening 32 and its associated opening 28 in printed circuit board 22 completely circumscribes the signal conductor 16 and eliminates the chance of electromagnetic radiation from pin 16 to the outside environment or from the outside environment back to pin 16.

Although the inventive concept has been shown using a capacitive printed circuit board and a separate board 40 (often referred to as a backplane board) for providing other electrical functions, the concept can easily be practiced using a single printed circuit board having some layers for capacitive effect and other layers for connection to signal and/or ground paths. For that matter, the illustrative board shown in FIG. 2, could have a single layer with paths connecting to the leads 83 and 81 in the same plane somewhat as shown for board 40 in FIG. 1.

The prime objective of this invention is to provide an inexpensive dielectric for accomplishing a capacitive connection between the shielded circuit connector such as 10 and chassis ground while still passing the RF signal to other circuitry without contamination from outside sources. The prior art approach has been to bring a shielded conductor into an appropriate (but very expensive) interface connector attached to the outside of a shielded container and then have another shielded circuit cable go from that connector to the printed circuit board mounted internal the shielded structure. Thus, there were often three shielded cable circuit connectors involved with one on each side of the shielded container and usually a further one attached to a device similar to item 10 mounted on the printed circuit board. The present inventive concept reduces the number of connectors by at least a factor of 2, eliminates the very expensive chassis ground connector interface of the prior art and, since the circuitry may all be contained on or within a multiple layer printed circuit board, can effectively shield the signal from deleterious electromagnetic effects.

While I have described at least two approaches to practicing the present invention with separate circuit boards or a combined function on a single circuit board, I wish to be limited not to what is disclosed but only to an approach using inexpensive dielectric material in multiple layers for providing a high frequency capacitive connection to one ground while DC isolating the signal ground from that said one ground as claimed in the appended claims.

I claim:

1. Shielded cable connector apparatus comprising, in combination:

multilayer capacitive card means, including upper and lower outside conductive layers, a signal passage opening therethrough which is electrically insulated from said upper and lower conductive layers, the upper and lower outside conductive layers being electrically directly connected to alternating layers of conductive material in the card means, the outside upper conductive layer of said card thereby being capacitively connected to the outside lower layer, for providing an electrical ground connection to said lower layer; and cable connector means attached to said card means, said cable connector means including a signal lead passing through but not electrically contacting the layers of conductive material, a direct electrical connection being formed between said outside upper conductive layer of said card means and a cable shield portion of said connector means.

2. Shielded cable connector grounding apparatus comprising, in combination:

capacitive printed circuit card means, including first and second outside conductive layers and a signal passage opening therethrough wherein the outside first conductive layer of said card is capacitively connected to the outside second layer, for providing an direct electrical ground connection via said second conductive layer; and cable connector means physically and electrically attached to said first layer of said card means, said cable connector means including a signal lead passing through said signal passage opening of said card means without electrically contacting the layers of conductive material, a direct electrical connection being formed between said outside first conductive layer of said card means and a cable shield portion of said connector means.

3. Low inductance shielded cable connection apparatus having isolated grounding means comprising, in combination:

dual sided circuit board means having first and second opposing side conductive surfaces with low inductance, capacitive interaction therebetween;

shielded cable connector means for connection to a cable having at least a signal lead and an associated shield, said connector having a shield portion directly electrically attached to said first conductive surface of said board means and having further signal and shield terminals adapted for connection to a printed circuit board; and ground terminal means, connected to said second conductive surface of said board means, for providing a low impedance capacitively coupled ground connection to said shield portion of said connector means.

4. The method of providing a low cost, low inductance capacitively coupled ground connection to a shielded cable connector using a printed circuit board having at least first and second capacitively coupled layers comprising the steps of:

attaching a shielded cable connector, which connector includes a signal conductor portion interior ground portion, to at least one layer of a multilayer printed circuit board, said one layer being capacitively connected to a grounding second layer;

electrically connecting circuit board terminals of the cable connector to circuit paths other than said grounding second layer; and connecting said grounding second layer to ground.

5. The method of claim 4 comprising the additional step of providing multiple contact points between the cable connector and said one layer of said circuit board, the contact point encircling the signal conductor portion of said cable connector.

6. Shielded cable connection apparatus comprising, in combination:

multilayer printed circuit board means including a first layer for direct electrical connection to a shielded cable connector, a second layer, capacitively connected to said first layer, for connection to ground and having shield and main signal pin openings in said first and second layers;

cable connector means attached to said first layer of said board means, said connector means further including a main signal pin positioned in said main signal pin opening in such a manner that it is electrically insulated from said first and second layers and including a shield pin positioned in said shield pin opening in such a manner that is directly electrically connected to said first layer and only capacitively connected to said second layer.

7. Shielded cable connector apparatus comprising, in combination:

multilayer printed circuit board means, including at least one exterior layer, a chassis ground second layer and a signal path layer, for providing a capacitive path to said chassis ground second layer and for providing isolated and independent signal and circuit ground paths to signal circuits of said signal path layer; and at least one shielded cable connector mechanically attached to said circuit board and electrically contacting said at least one exterior layer of said board means.

8. Apparatus as claimed in claim 7 comprising, in addition:

a signal conductor portion of said cable connector situated interior said cable connector and electrically shielded by exterior portions of said connector;

means for ensuring that the connector electrically contacts said at least one exterior layer at a multiplicity of points substantially encircling said signal conductor.

* * * * *